US006032881A

United States Patent [19]

Bass et al.

[11] Patent Number: 6,032,881

[45] Date of Patent: Mar. 7, 2000

[54] PROCESS TO REMOVE RADIOACTIVE ELEMENTS PRESENT IN BULK LOW-GRADE WASTE

[75] Inventors: Joshua D. Bass; Clayton H. Kass, both of Modjeska, Calif.

[73] Assignee: Environmental Solutions & Technology, Inc., Idaho Falls, Id.

[21] Appl. No.: 09/134,719

[22] Filed: Aug. 14, 1998

[51] Int. Cl.[7] ..... B02C 7/08

[52] U.S. Cl. ..... 241/24.12; 241/24.14; 241/27.3; 241/DIG. 38; 209/214; 209/221; 209/226; 209/228

[58] Field of Search ..... 241/24.12, 24.14, 241/27.3, DIG. 38; 209/213, 214, 221, 225, 226, 227, 228

[56] References Cited

U.S. PATENT DOCUMENTS

| | | | |
|---|---|---|---|
| 3,629,135 | 12/1971 | Wilding | 252/301.1 |
| 3,893,845 | 7/1975 | Mahaffey et al. | 75/10 R |
| 5,468,456 | 11/1995 | Nunez et al. | 423/10 |
| 5,523,514 | 6/1996 | Cauquil et al. | 588/20 |
| 5,681,434 | 10/1997 | Eastlund | 204/156 |
| 5,750,822 | 5/1998 | Gotovchikov et al. | 588/11 |
| 5,868,909 | 2/1999 | Eastlund | 204/156 |

*Primary Examiner*—Joseph J. Hail, III
*Assistant Examiner*—William Hong
*Attorney, Agent, or Firm*—Malin, Haley & DiMaggio, P.A.

[57] ABSTRACT

A method and system for separating, collecting and isolating radioactive metallic elements from low grade, dry, solid non-metallic nuclear bulk waste that includes physically degrading the low grade waste by shredding or grinding into small pieces, configuring the bulk waste into a waste stream, bombarding the waste stream with microwave energy at a preselected frequency treating the waste stream in a time varying magnetic field, causing the radioactive particles to disperse away from the bulk waste and collecting the separated micron sized radioactive particles. The present method and system provide for a low cost, non-complex system of separating out conductive radioactive particles from essentially non-metallic, dry, low grade nuclear waste allowing safe return to the environment of 95% to 99%, by volume, of the processed nuclear waste, greatly reducing the volume of nuclear waste that must be safely stored.

4 Claims, 5 Drawing Sheets

PROCESS TO REMOVE RADIOACTIVE ELEMENTS PRESENT IN BULK LOW-GRADE WASTE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention comprises a process and system for efficiently separating, collecting and removing metallic radioactive elements (nucleides) from predominantly solid, non-metallic bulk low-grade nuclear waste.

2. Description of Related Art

Nuclear waste is comprised of many different kinds of radioactive materials. These materials are classified into different types, called waste forms. Each waste form has specific characteristics that require certain methods of treatment and storage. A variety of techniques and methods have to be applied to treat components of nuclear waste.

Radioactive nuclear waste can be grouped into four categories, namely, high-level waste, transuranic waste, low-level waste, and uranium mill tailing.

Radioactive waste management is the treatment and containment of radioactive waste. The number one aim in the safe handling and containment of radioactive waste is the prevention of radiation damage to humans and the environment by controlling the dispersion of radioactive materials. Nuclear waste management is mainly controlled by policies of the United States government. Because of the expected increase in quantities of waste containing materials or those contaminated with transuranic elements, and because of the long half life and specific radioactive toxicity of these elements, the U.S. government policy requires that most transuranic waste must be solidified. A variety of technologies exist for this conversion including calcination, vitrification, oxidation, and metallurgical smelting depending on the primary waste.

A typical solidification process chiefly for all forms of waste is spray calcination-vitrification. In this process, atomized droplets of waste fall through a heated chamber where flash evaporation results in solid oxide particles. Glass making solid frit or phosphoric acid can be added to provide for melting and glass formation either in a continuous melter or in the vessel that will serve as the waste canister. The molten glass or ceramic is cooled and solidified.

Ironically using these processes increases the volume of waste material that has to be disposed and stored somewhere. Vitrification processes are also expensive to operate.

The present invention greatly increases the efficiency of treating and storing low grade nuclear waste while significantly reducing the volume of material that must be stored because of its radioactive toxicity at a great cost savings.

Vitrification has not been a good solution because it actually increases the volumes of solids that have to be stored safely. Using the present invention, it is believed that 95 to 99% volume of the low grade nuclear bulk waste can be restored safely to the environment eliminating the need for expensive large volume bulk storage.

The present invention comprises a process and system for use with transuranic and low-level nuclear waste to separate metallic radioactive materials from the low-grade bulk non-metallic waste, allowing the radioactive elements to be separated, lifted away, captured, and concentrated into a smaller volume, leaving the remaining non metallic bulk waste non-radioactive and ready for free release into the environment after a full processing cycle, or less radioactive and ready for more conventional waste handling after a partial cycle.

The process and system are specifically ideal for dry, non-metallic, low-grade nuclear waste containing transuranic radioactive elements or other radionucleides making up one particle per million (PPM) (or less) particulate density.

Several complex methods are shown in the prior art for separating nuclear materials. U.S. Pat. No. 3,629,135 issued to Wilding, Dec. 21, 1971, shows a method of dissolving radioactive contaminated organic ion exchange resins by heating the resin in a solution of nitric acid and potassium permanganate.

U.S. Pat. No. 3,893,845 issued to Mahaffey, et al, Jul. 8, 1975, shows a method for reducing matter to constituent elements and separating one of the elements from the other elements. Basically, this is accomplished in a high temperature environment (plasma). The reduction is caused by raising the input compound to a high temperature so that the input compound is thermally dissociated. This can also be affected by chemically reducing the compound to a gas consisting of a specie or element which can be more readily ionized and another product of the chemical reduction reaction. Separation therefore is effected by partly ionizing one of the species to be separated and moving the resultant mixture of gas and plasma through a magnetic field shaped to increase intensity in direction flow of the gas and plasma. The plasma is squeezed by the magnetic field creating a force on the ionized specie only, producing separation.

U.S. Pat. No. 5,523,514 issued to Cauquil, Jun. 4, 1996, shows a process for dissolving plutonium and other radioactive elements that are present in solid or liquid products by microwave heating. The process also uses solutions of toxic nitric acid and hydrofluoric acid.

U.S. Pat. No. 5,681,434, issued to Eastlund, Sep. 28, 1997, shows a method and apparatus for ionizing all the elements in a complex substance such as radioactive waste and separating some of the elements from other elements. The principle method used is again high temperature plasma confined by toroidal magnetic fields. One method utilizes plasma (high temperatures) confinement by toroidal magnetic fields as a gate to regulate when and where specific elements are collected. The apparatus is a large volume plasma processor with multiple containment vessels. The system requires tremendous amounts of heat energy.

The use of the present invention for separating radioactive materials from non-metallic bulk waste does not employ high temperature plasma requirements or the use of toxic chemicals. Metallic radioactive materials at the (micron size) level can be separated from large volumes of non-metallic low grade nuclear waste, collected and concentrated together in a significantly smaller volume, and safely stored efficiently and economically in accordance with the present invention.

BRIEF SUMMARY OF THE INVENTION

A process and system for separating metallic radioactive particles present in non-metallic bulk low-grade nuclear waste. The radioactive elements are removed from the bulk nuclear waste materials and are captured into a concentrated mass, stripping the bulk waste of radioactive particles, and allowing for safe release of the bulk waste after a full processing cycle. Examples of bulk waste non-metallic materials would be clothing, soil or concrete that has been exposed to radioactive nuclear particles.

Initially, large pieces of dry low-grade radioactive non-metallic bulk waste such as concrete or contaminated clothing must be physically prepared through the use of either a device or machine that will grind and break the concrete into small, gravel-sized particles (1 cm diameter or length) or, based on the type of bulk material such as clothing, shredded to 1 cm pieces, to reduce the bulk material into very small pieces.

Once the low grade bulk waste material has been physically reduced to small sized pieces, a waste stream is formed by mounting a layer of shredded material on a conveyor belt or conveyor system. The waste stream depth can vary and typically could be from 2 cm–10 cm. The waste stream, starting from bulk waste, goes through preprocessing, sorting, repackaging, some of which is rejected through an eligibility sensing process. The eligible waste (non-metallic low grade) is then sent to a microwave chamber where the waste is bombarded with microwave energy of a predetermined frequency. The excited waste is then transferred to a magnetic separating chamber. Within the magnetic separating chamber, the radioactive (conductive) particles separate from the non-metallic bulk waste and are trapped in a collection reservoir which can be periodically flushed to remove the radioactive nucleides and particles.

After magnetic separating the remaining bulk waste which has had its radioactive nucleides removed, is transferred to another sensor which checks the condition for radioactivity for release back into the environment safely. Bulk waste materials that are still radioactive are separated for possible additional treatment. The radioactive nucleides and particles are also collected and are transferred to a special radioactive product handling system.

One of the important steps in this process is exciting the bulk waste with microwave energy. A second critical step utilizes magnetic separation. Both of these steps are discussed in greater detail below.

The bulk waste stream is radiated in a chamber with microwave energy, tuned to a predetermined frequency, to provide energy that agitates valence electrons of radioactive metallic compounds on top of and within the layer of the waste stream, thereby imparting sufficient kinetic energy to the radioactive metallic compounds within the bulk materials, thereby breaking the radioactive metallic particles free from any surface or matrix bonds with the non-metallic materials in the waste stream.

While or after the waste stream is being radiated with microwave excitation, the waste stream is transferred to a magnetic separation chamber where the bulk waste is subjected to a time variable magnetic field. The radioactive metallic particles within the waste stream therein interact with a changing magnetic flux field which may be generated by an array of one or more permanent magnets, or an electromagnet generating a time varying magnetic field within the magnetic separation chamber. The purpose of the time varying magnetic field within the separation chamber is to cause the radioactive, micron sized particles to migrate to a collection reservoir, thereby completely separating the radioactive metallic particles from the surrounding bulk waste.

Each separated radioactive metallic particle is a conductor and will experience a force in a time varying magnetic field regardless of its inherent level of magnetism. This force is the result of momentary dipoles generated by the movement of electrons ("eddy currents") within the conductive materials.

Any particle with induced current can be approximated as a sum of infinitesimal current loops. Each current loop generates a magnetic dipole moment which interacts with the ambient magnetic field to produce a net force. For an infinitesimal loop with a dipole m the force equation is:

$$\vec{F}=\nabla\vec{m}\cdot\vec{B}$$

The force on a finite particle can be expressed as the integral sum of the forces on each of its infinitesimal dipoles $$F=\int_{\Omega}\tilde{v}\,(\vec{m}\cdot\vec{B})$$

The force on a reasonably small particle, once the dipole moment has been determined, can be approximated with a single infinitesimal loop equation. For the purposes of this calculation, the particle is treated as a single current loop oriented perpendicular to the $\vec{B}$ field. In the loop a change of magnetic field induces a voltage, and thus a current:

$$I=-(1/R)(d/dt)(\Phi)$$

Where: $\Phi=\int\int\vec{B}\cdot d\vec{A}$

R:= Loops resistance $\vec{B}$:= Magnetic vector field $d\vec{A}$:=differential area vector (parallel to $\vec{B}$)

The induced current in turn creates a momentary dipole in the particle:

m=IA

As the force equation above depends on the gradient of $m\cdot\vec{B}$, a spacially independent magnetic field would produce no movement. This is because m although possibly variant in space, is not a true field vector having only one value at any given time. One must note, however, that the possibility of a magnetic field gradient caused by the presence of a conductor cannot be dismissed. In any case, a standard spacially variant field will put force on the dipole.

$$F=\nabla\vec{m}\cdot\vec{B},\text{ or}$$

$$F=\nabla-[1/R](d/dt)\,\Phi]\vec{A}\cdot\vec{B}$$

The overall effect is to create a Lenz's law type force which opposes change. The radioactive metallic particle will experience a force which tends to keep $\Phi$ constant. For instance, in the case where a constant spacially variant magnetic $\vec{B}$ field is in motion, the radioactive particle will feel a force towards this source if the $\vec{B}$ field moves away from the particle and away from the source if the $\vec{B}$ field moves toward the particle.

The force on currents induced by magnetic field flux is a dominant first order effect. Higher order effects contribute additional terms to the force, which may or may not produce significant effects.

In the present invention, the time variable magnetic field will cause movement of the separated metallic radioactive particles towards a capture screen composed of Palladium, Platinum, or other adsorptive material, where they are eventually removed with a flushing medium. The magnetic strength of the field could possibly range from 5,000 to 10,000 gauss or other field strength.

The processed, contaminant free, bulk waste stream, once freed of the radioactive particles, is then safely removed by the conveyor system. Thus, The processed material may then be disposed of accordingly.

It should be realized that the great advantage of this invention is that by separating and isolating the micron sized metallic radioactive particles (typically the transuranics and metallic nucleides) we generate a radioactive product in a highly concentrated form, greatly reducing the amount of volume required for the storage of nuclear waste. Also, large volumes of bulk waste material (95%–99%) are freed up that can be safely returned to the environment without radioactive hazard.

It is an object of this invention to provide an improved, low cost process for separating polyatomic metallic radioactive particles from non-metallic bulk low grade nuclear waste efficiently and thoroughly.

It is another object of this invention to provide an improved system for separating, collecting and storing radioactive particles cost effectively and reliably from non-metallic bulk low-grade nuclear waste efficiently and completely leaving 95%–99% volume of bulk waste safe and non-contaminated.

In accordance with these and other objects which will become apparent hereinafter, the instant invention will now be described with particular reference to the accompanying drawings.

DETAILED DESCRIPTION OF THE INVENTION

Figure 1:
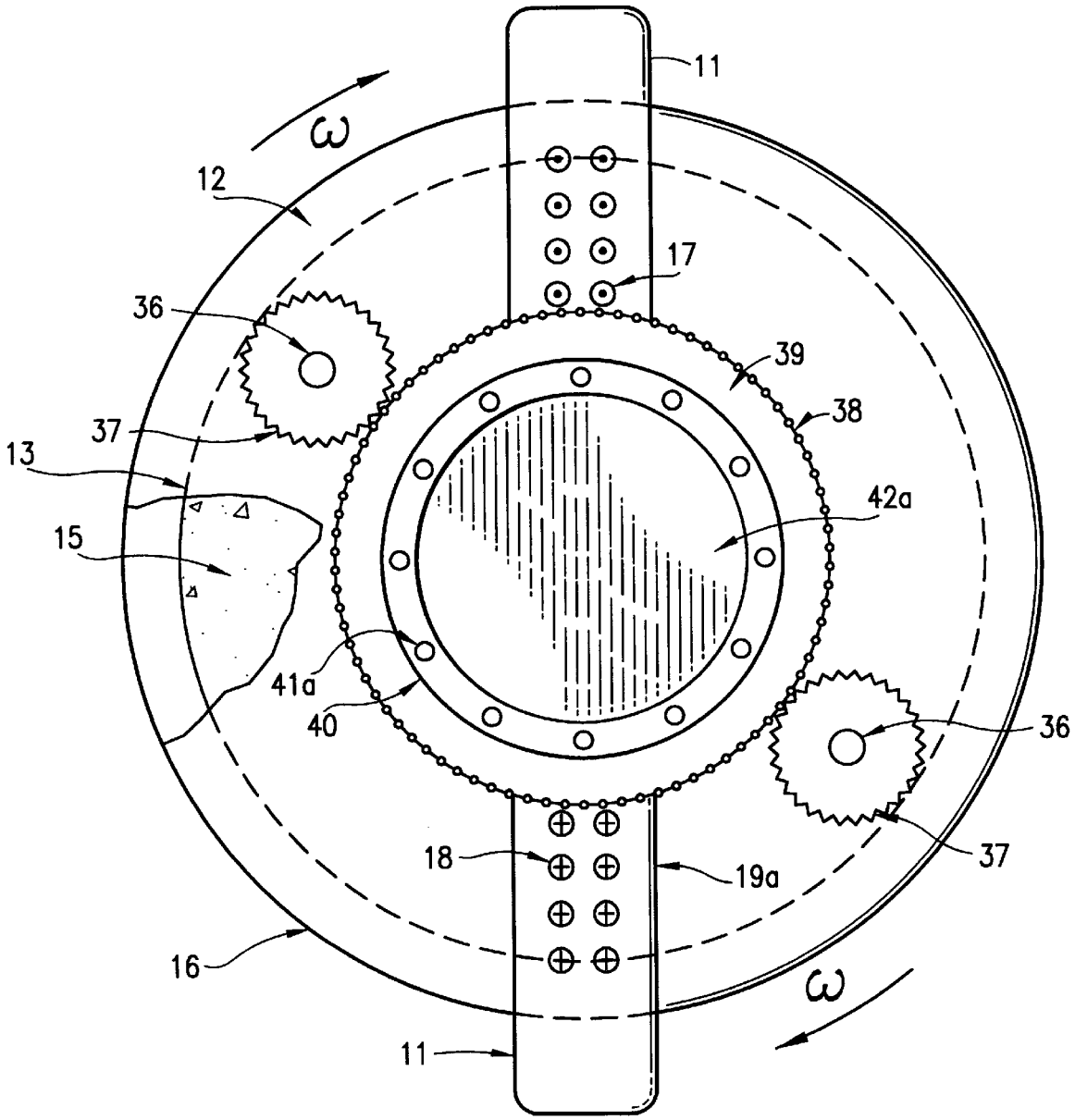
FIG. 1 shows a top plan view of the magnetic separation chamber in accordance with the present invention.

Referring now to the drawings and in particular FIGS. 1 through 4, the magnetic separation chamber that separates the bulk non-metallic low grade nuclear waste from the metallic radioactive particles is shown in FIGS. 1–4.

The magnetic separation chamber includes a cylindrical containment shell 16 that provides exterior shielding from the radioactive material inside that is being processed. A pair of magnets 11 are mounted outside the containment shell 16 diametrically across from each other that is used to create a magnetic field inside the separation chamber. As shown in FIGS. 1 through 4, bulk waste 15 which is low grade nuclear waste consisting of dry non-metallic waste and radioactive nucleides and non-conductive particles, is disposed within a fine grade mesh 13 that prevents bulk material from reaching the capture screen 12 and includes a rotating corkscrew agitator 20 that agitates bulk waste to assure that the radioactive particles are exposed through the magnetic flux generated by magnet 11. A drive shaft 14 disposed coaxially within the cylindrical containment chamber 16 and is used to rotate the corkscrew agitator 20. The bulk waste is moved from the top of the containment shell 16 to the bottom of the shell 16 or corkscrew agitator 20. The corkscrew agitator is made of a material such as a PVC plastic that will not interfere with the variable magnetic flux field generated in the chamber. FIG. 1 shows the direction of the magnetic field out of the drawing indicated at 17 and of the direction of the magnetic field into the drawing indicated at 18.

The outer perimeter inside the containment shell 16 includes a capture screen 12 that is made out of palladium and/or platinum in a mesh or honeycomb with maximum surface area array that can be flushed with a liquid medium such as liquid nitrogen to collect nucleides and radioactive particles that are adsorbed by the palladium and platinum.

FIG. 1 shows a pair of gears 37 that are driven by a pair of gear shafts 36 which are used to engage vertical gear teeth 38 attached to an annulus 39 which includes a rotating torroid attached to magnet 11 and the ferromagnetic bars 19*a* and 19*b* which are used as field guides to concentrate the magnetic field into the separation chamber vertically. A bearing mount 40 includes a bearing housing which allows the annulus 39 to freely rotate around the flushing mediums entry ports and valves 41*a*.

The upper portion of the rigid containment shell includes a plurality of flush fluid entry ports 41*a* where the flushing medium or flushing fluid enters into the capture screen 12 through the very top of the magnetic separation chamber. Thus the wall portion that contains the entry areas 41 a are fixed while the annulus 39 rotates around the upper portion of shell 16.

Figure 3:
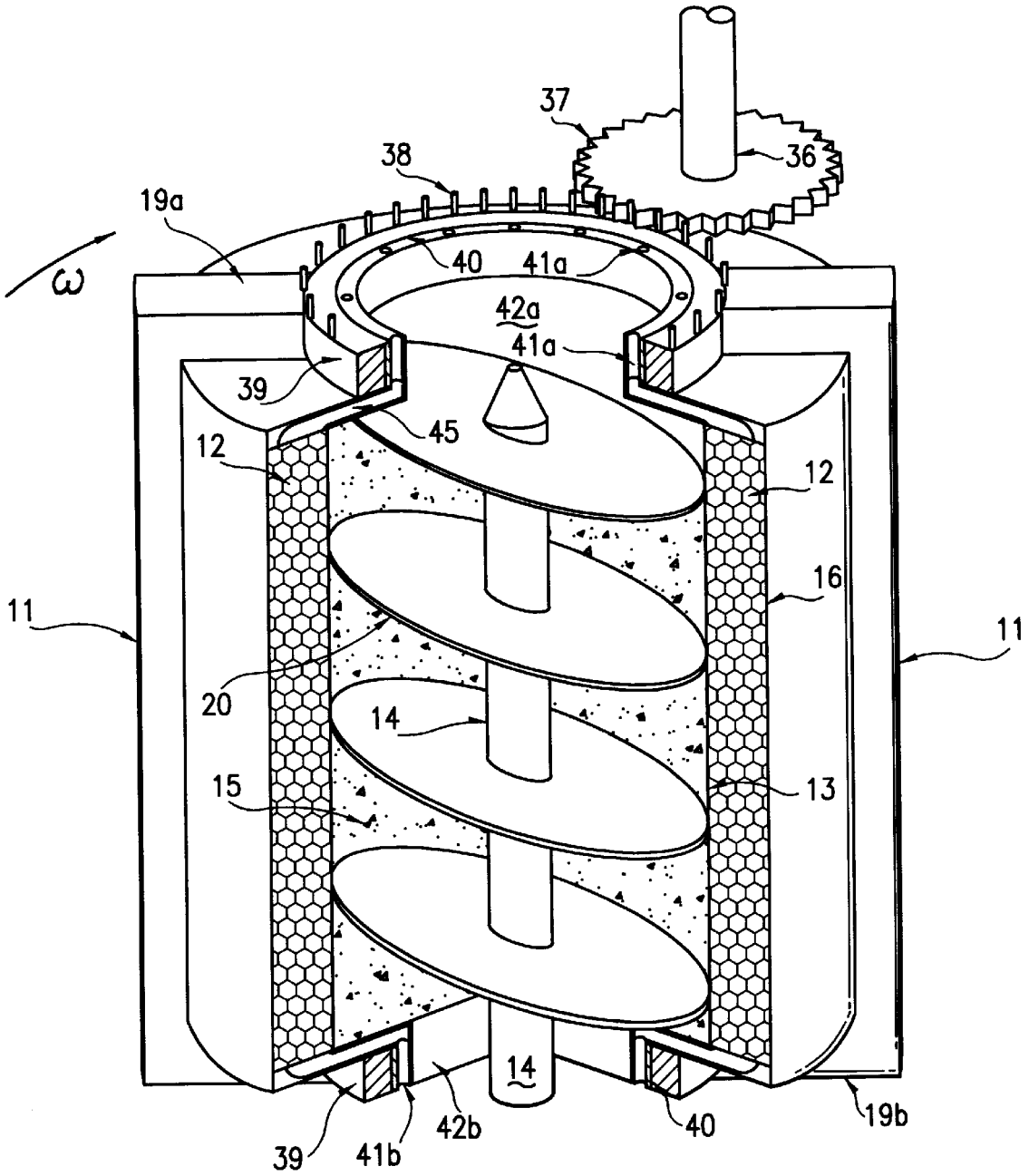
FIG. 3 shows a perspective view, partially cut away of a schematic view of the magnetic separation chamber in accordance with the present invention.

Referring now to FIG. 3, a top opening 42*a* is shown that allows for the bulk waste entry through a control valve (not shown) to engage the corkscrew agitator.

Figure 4:
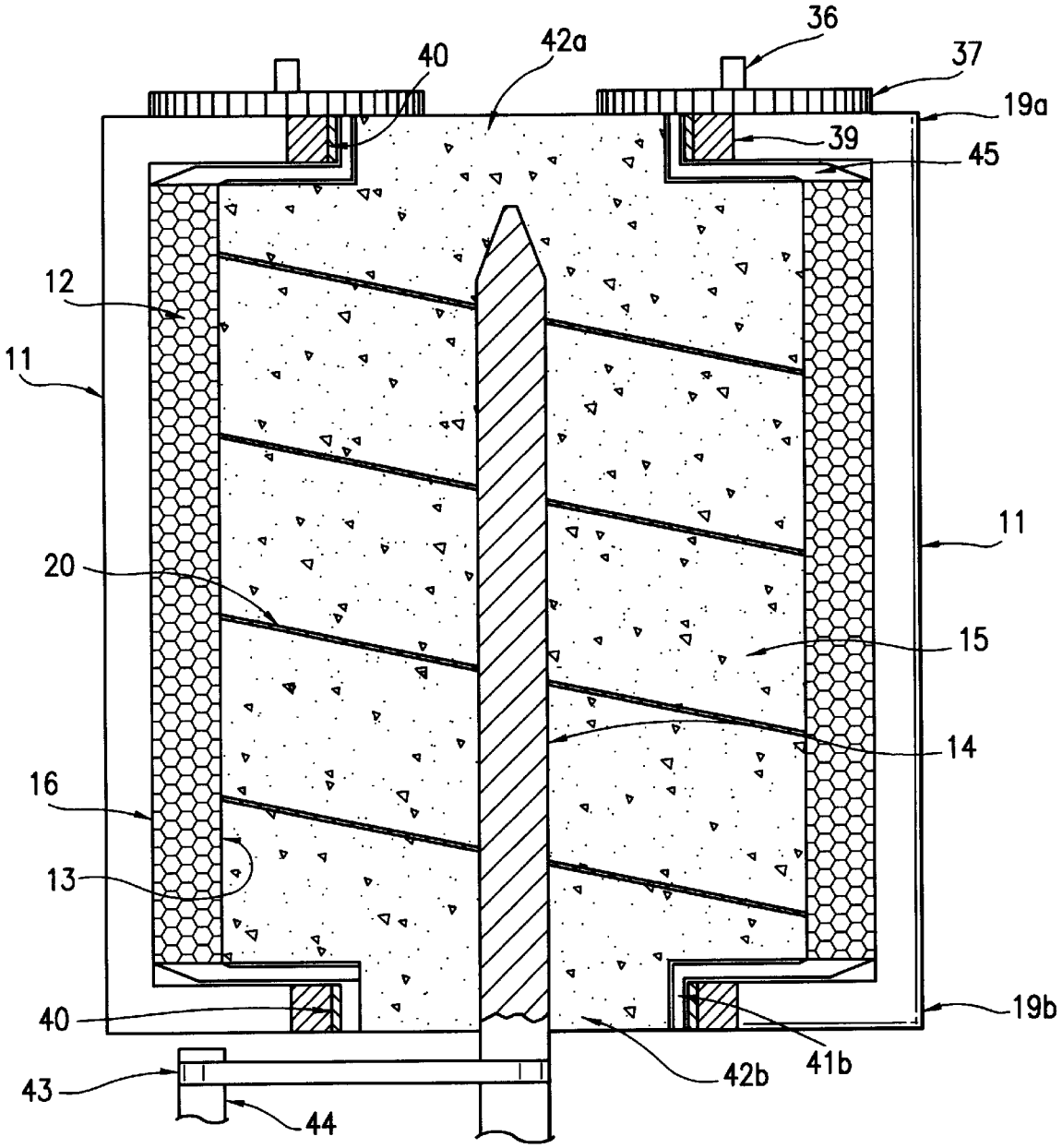
FIG. 4 shows a side elevational view and cross section representing the magnetic separation chamber in accordance with the present invention.

FIG. 4 shows the flush fluid exit areas 41*b* at the bottom of the magnetic separating chamber and also a large area for the processed bulk waste exit which allows the treated waste to exit the magnetic separation chamber at a control point with a control valve (not shown). As shown in FIG. 4, a belt 43, the belt drive to rotate drive shaft 14, is shown connected to a motor shaft 44 that drives the belt 43.

FIG. 4 shows a percolating reservoir 45 that allows the flushing medium, such as liquid nitrogen, to spread evenly throughout the capture screen 12 and its port 41*a* above.

Figure 2:
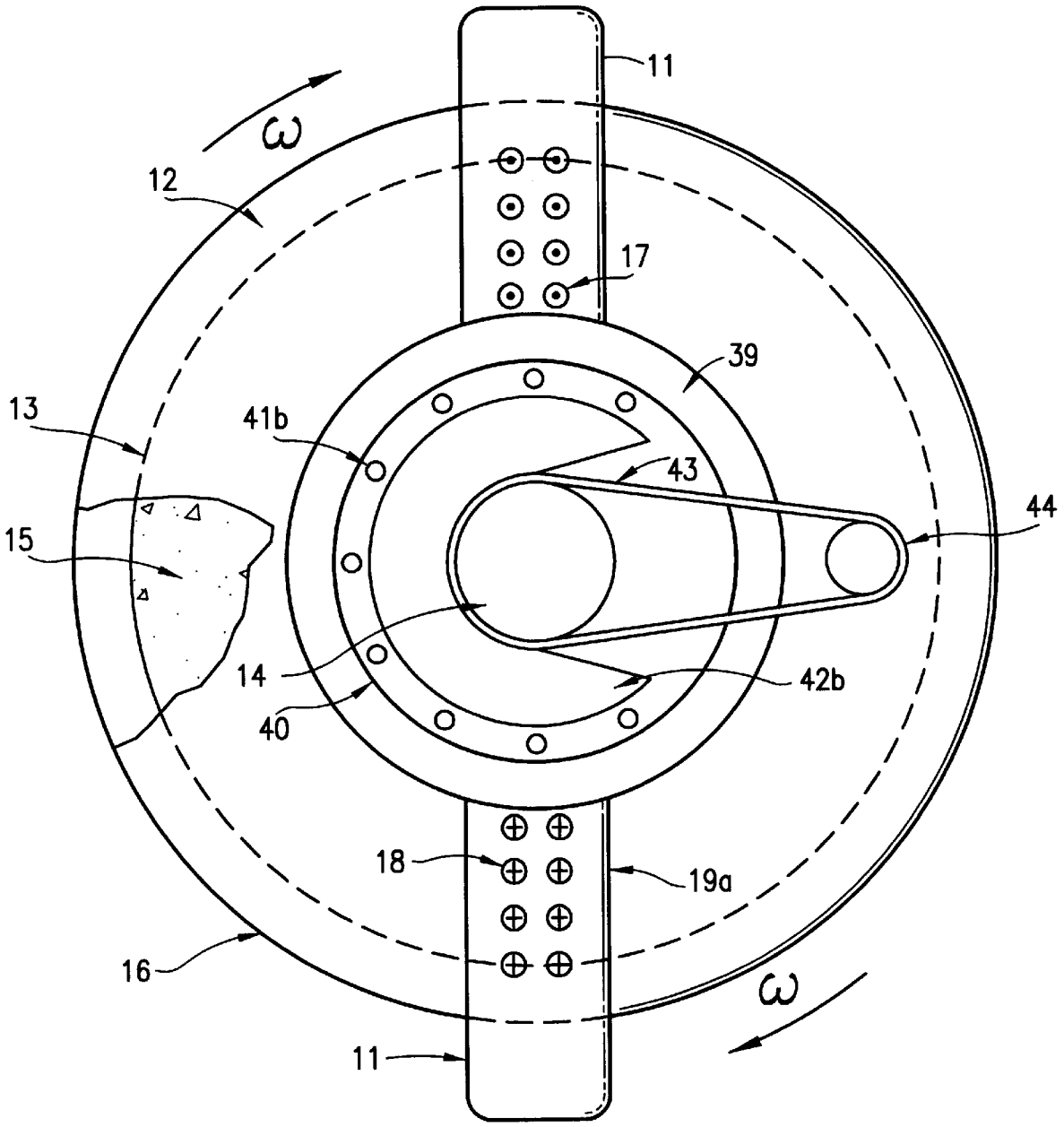
FIG. 2 shows the schematic representation of a bottom plan view of the magnetic separation chamber in accordance with the present invention.
Figure 5:
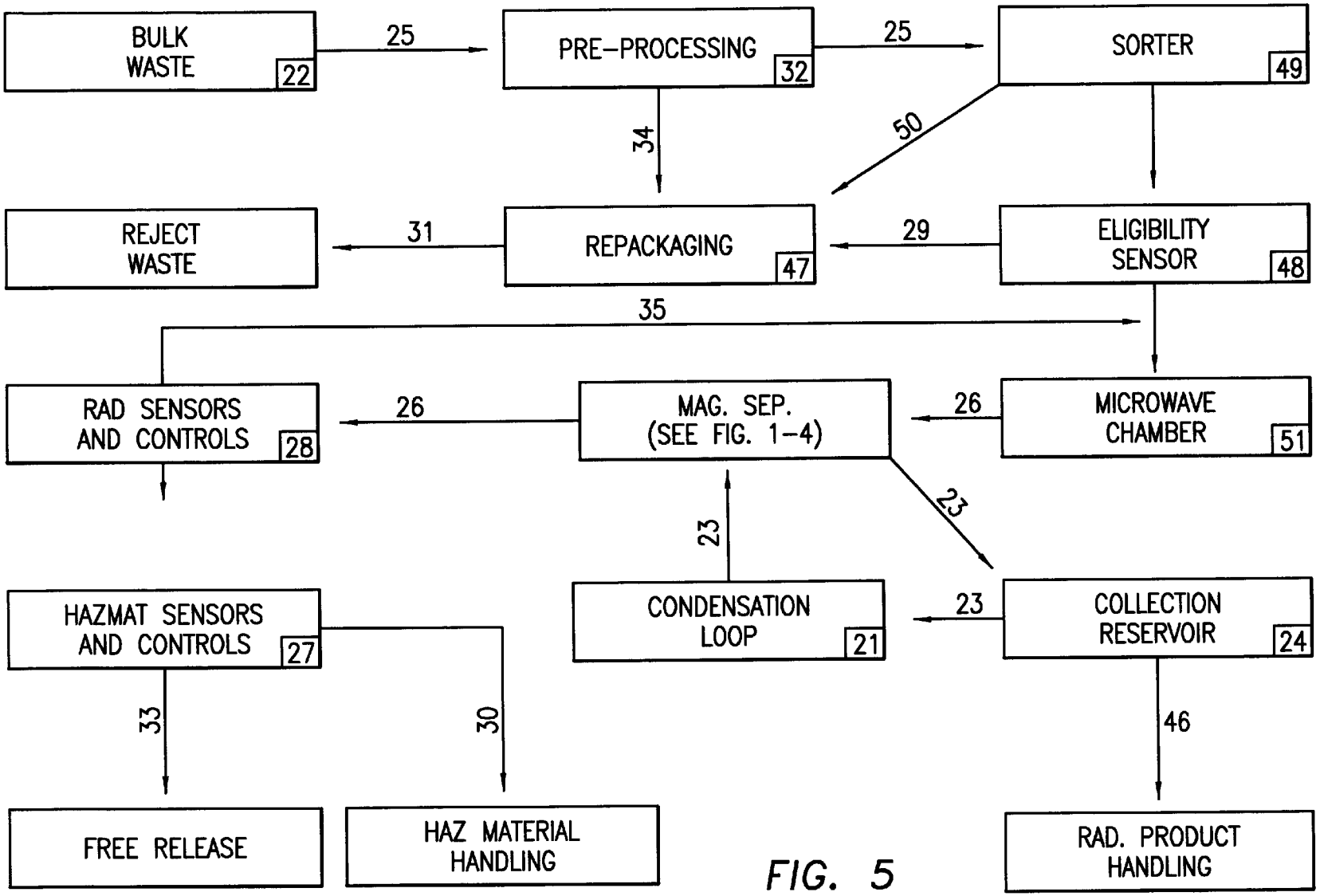
FIG. 5 shows a flow chart and a schematic diagram representing the process and system utilized in the present invention.

Looking at FIGS. 2 and 4, the bearing housing 40 is shown also at the bottom and includes the flushing fluid exit 41*b* that allows the nucleides and radioactive particles contained in the flushing fluid to exit the magnetic separation chamber after the capture screen 12 has received and collected the radioactive particles. The flushing fluid will then go to a collection reservoir shown in FIG. 5 and a condensation loop in which the flushing medium such as liquid nitrogen is condensed back to a liquid phase. As shown in FIG. 5, the collection reservoir 24 holds the liquid flushing medium and allows the radioactive particles and nucleides to settle to the bottom.

Referring back to FIG. 3, the operation of the magnetic separating chamber is addressed. Bulk radioactive nuclear waste which has been excited by microwave chamber enters area 42*a* at the top and engages the corkscrew agitator 20 which is rotating along driveshaft 14. The magnet 11, including the rotating torriod attached to the ferromagnetic bar and the magnets, is rotated by gear 37, causing a time variable magnetic field in the axial direction within the magnetic separation chamber, parallel to the drive shaft 14. The radioactive conductive metallic particles will thus experience a force from the varying magnetic flux throughout the chamber causing the radioactive particles to migrate to capture screen 12 where the nucleides and radioactive particles are adsorbed by the palladium and/or platinum screen 12. As the radioactive particles collect on the screen 12, a flushing medium, such as liquid nitrogen, is periodically transferred through the inlet areas 41*a* through the screen 12 and exits at 41*b*.

The bulk waste which has been purged of the radioactive particles is transferred through opening 42*b* in the bottom of the separation chamber.

Referring now to FIG. 5, the entire process and system is shown beginning with a bulk waste chamber 22 that contains unprocessed bulk waste that has yet to enter the magnetic separation process. A conveyor system 25 takes the bulk waste to a preprocessing system 32 which tests radiation content of bulk waste, shreds and prepares waste for sorting and rejects bulk waste with high radiation levels. The rejected bulk waste will be transferred along 34 which is to a repackaging unit at 47 where all rejected unprocessed waste is recontained into 55 gallon drums and transferred at 31 as rejected waste. The entry conveyor 25 takes the preprocessed bulk waste to the waste sorter 49 which again sorts unprocessed waste to an eligibility sensor 48 which tests unprocessed waste for process eligibility based upon metal and hazmat content (hazardous material). From the eligibility sensor 48, hazardous radioactive waste that fails the hazmat test is returned at 29 to repackaging 47. The eligible material will continue through microwave chamber 51 where it is radiated with microwave energy of a predetermined frequency. The microwave chamber radiates radioactive particles and nucleides with microwaves just prior to magnetic separating. An exit conveyor 26 carries the processed waste from the microwave chamber 51 to the magnetic separating chamber described above. The magnetic separation chamber includes a fluid flushing transfer system 23 to a collection reservoir 24 that holds the liquid flushing medium and allows the radioactive nucleides and particles to settle to the bottom of the collection reservoir 24 from which the radioactive captured waste 46 is transferred to a radiation product handling. The flushing fluid 23 is also transferred to a condensation loop 21 in which the liquid nitrogen condenses back to a liquid phase to be returned to the magnetic separation chamber as described above.

The processed bulk waste leaves the magnetic separation chamber through an exit conveyor 26 that carries the processed waste to radioactive sensors and controls 28 which detect levels of radiation in the processed non-metallic bulk waste material. The bulk waste material is also transferred to hazmat sensors and control 27 to detect any remaining hazardous materials. The processed waste that is now fit for environmental disposal is transferred as free release waste to the environment or any desired area. Any hazardous waste 30 at the hazmat sensor control 27 is transferred to a hazardous material handling. Some of the material that was rejected processed waste which has gone through one separation cycle but does not meet free standards at 35 can be returned back to the microwave chamber 51.

The radioactive captured waste 46 constitutes the metallic radioactive particles and nucleides that have been collected from the collection reservoir 24 and is now subjected to radioactive product handling. This amounts in volume terms to a very, very small percentage, perhaps 1% to 5%, of the volume of the bulk weight material entering at bulk waste site 22. The free release waste at 33 should represent approximately 95%–99% of the total volume of the material that entered at the bulk waste site 22.

Thus, the present invention and the system shown with this process greatly increases the efficiency of separating radioactive particles from low grade, bulk non-metallic nuclear waste while greatly reducing the cost of the process and system.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for separating and collecting radioactive conductive elements from low grade dry solids, predominately non-metallic nuclear bulk waste comprising the steps of:

(a) physically degrading dry, solid, bulk low grade nuclear waste by shredding said bulk waste into small pieces;

(b) configuring the bulk nuclear waste into a waste stream layer of a predetermined depth;

(c) generating a time varied magnetic field within a magnetic separating chamber;

(d) disposing said bulk waste in said magnetic separation chamber;

(e) separating radioactive particles from the bulk waste stream within a magnetic separation chamber;

(f) gathering separated radioactive metallic particles at strategically located areas within said magnetic separation chamber;

(g) removing said separated radioactive particles from said separation chamber whereby the remaining bulk waste material constitutes non-radioactive, non-metallic waste.

2. The method for separating radioactive dry metallic elements as in claim 1, including the step of bombarding the degraded waste stream within the magnetic separating chamber with microwave energy of a predetermined frequency to enhance separation of the radioactive metallic particles and elements from the predominantly non-metallic bulk waste.

3. The method as in claim 1 that includes the step of separating micron sized radioactive particles from the bulk waste stream.

4. The method as in claim 1 including the step of gathering the separated radioactive particles on an adsorptive screen; and flushing the screen with a fluid to remove and collect the radioactive particles collected on the screen.

* * * * *